US012256879B2

(12) United States Patent
Cardano et al.

(10) Patent No.: US 12,256,879 B2
(45) Date of Patent: Mar. 25, 2025

(54) DISHWASHER WITH TRAY

(71) Applicant: WHIRLPOOL CORPORATION, Benton Harbor, MI (US)

(72) Inventors: Fabio Cardano, Galliate (IT); Umit Can Koralay, Milan (IT); Giuseppina Arresta, Ternate (IT); Mark Steven Feddema, Kalamazoo, MI (US); Hrushikesh Chandrakant Prabhu, Pune (IN)

(73) Assignee: Whirlpool Corporation, Benton Harbor, MI (US)

( * ) Notice: Subject to any disclaimer, the term of this patent is extended or adjusted under 35 U.S.C. 154(b) by 0 days.

(21) Appl. No.: 18/511,316

(22) Filed: Nov. 16, 2023

(65) Prior Publication Data

US 2024/0081610 A1 Mar. 14, 2024

Related U.S. Application Data

(63) Continuation of application No. 17/695,395, filed on Mar. 15, 2022, now Pat. No. 11,986,144.

(51) Int. Cl.
*A47L 15/50* (2006.01)

(52) U.S. Cl.
CPC ..... *A47L 15/502* (2013.01); *A47L 15/504* (2013.01)

(58) Field of Classification Search
None
See application file for complete search history.

(56) References Cited

U.S. PATENT DOCUMENTS

| | | | |
|---|---|---|---|
| 7,862,664 | B2 | 1/2011 | Choe et al. |
| 8,163,103 | B2 | 4/2012 | Shin et al. |
| 9,516,990 | B2 | 12/2016 | Graute et al. |
| 9,833,122 | B2 | 12/2017 | Shin et al. |
| 10,743,742 | B2 | 8/2020 | Buesing et al. |
| 10,765,292 | B2 | 9/2020 | Ko et al. |
| 10,779,705 | B2 | 9/2020 | Ko et al. |
| 2005/0242046 | A1 | 11/2005 | Lee |
| 2008/0156358 | A1 | 7/2008 | Shin et al. |
| 2010/0155280 | A1 | 6/2010 | Graute et al. |
| 2017/0027412 | A1 | 2/2017 | Chan et al. |
| 2021/0000325 | A1 | 1/2021 | Ko |

FOREIGN PATENT DOCUMENTS

| | | | |
|---|---|---|---|
| CN | 106343937 | A | 1/2017 |
| CN | 209712803 | U | 12/2019 |
| DE | 20307731 | U1 | 10/2004 |
| DE | 10322423 | A1 | 12/2004 |
| EP | 0901770 | A3 | 5/1999 |
| EP | 1306046 | A1 | 5/2003 |
| EP | 1707101 | A2 | 10/2006 |
| EP | 2103245 | A1 | 9/2009 |
| EP | 2934277 | A0 | 6/2014 |
| EP | 3409182 | A1 | 12/2018 |
| WO | 2014094893 | A1 | 6/2014 |
| WO | 2019192910 | A1 | 10/2019 |

*Primary Examiner* — Levon J Shahinian
(74) *Attorney, Agent, or Firm* — McGarry Bair PC

(57) ABSTRACT

A reversible tray for a dishwasher a reversible tray carried by the dish rack and removably disposed within the dish rack to flip between a first position and a second position.

20 Claims, 10 Drawing Sheets

DISHWASHER WITH TRAY

CROSS REFERENCE TO RELATED APPLICATIONS

This application is a continuation application of U.S. patent application Ser. No. 17/695,395, filed Mar. 15, 2022, now U.S. Pat. No. 11,986,144, issued May 21, 2024, which is hereby incorporated herein by reference in its entirety.

BACKGROUND

Contemporary automatic dishwashers for use in a typical household can include a tub and one or more dish holders, such as upper and lower racks or baskets, for supporting soiled dishes within the tub. Optionally, some dishwashers come with a third or top rack located in the tub above the upper rack. A spray system is provided for re-circulating wash liquid throughout the tub to remove soils from the dishes loaded into the racks. The dishwasher can also include a controller that implements a number of pre-programmed cycles of operation to wash dishes contained in the tub.

BRIEF DESCRIPTION

The disclosure relates to a dishwasher for treating dishes according to a cycle of operation. The dishwasher has a tub at least partially defining a treating chamber, a dish rack received within the treating chamber for supporting dishes, and a reversible tray carried by the dish rack and removably disposed within the dish rack to flip between a first position and a second position, the reversible tray having a first sidewall and a second sidewall and a base wall angled with respect to the first and second sidewalls, wherein the base wall divides the reversible tray into a primary container and a secondary container, the primary container configured to receive dishes when in the first position and the secondary container configured to receive dishes when in the second position.

Another aspect of the disclosure relates a reversible tray for a dishwasher having an upper dish rack and a lower dish rack. The reversible tray is carried by one of the upper or lower dish racks and removably disposed within the upper or lower dish rack to flip between a first position and a second position. The reversible tray has a first sidewall and a second sidewall and a base wall angled with respect to the first and second sidewalls. The base wall divides the reversible tray into a primary container and a secondary container, the primary container is configured to receive dishes when in the first position and the secondary container is configured to receive dishes when in the second position.

DETAILED DESCRIPTION

Figure 1:
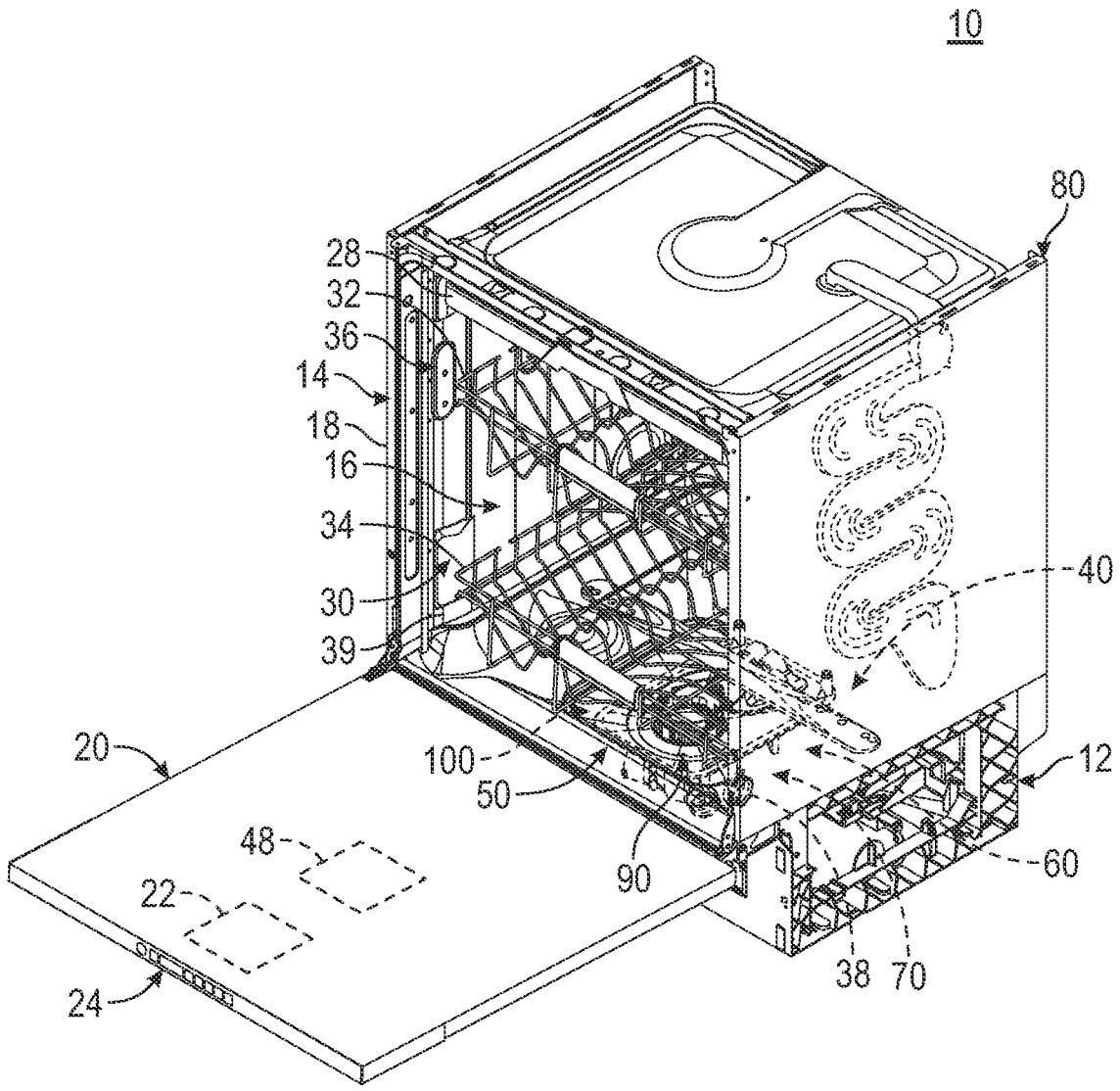
FIG. 1 is a right-side perspective view of an automatic dishwasher having multiple systems for implementing an automatic cycle of operation and including a dish rack.

FIG. 1 illustrates an automatic dishwasher 10 capable of implementing an automatic cycle of operation to treat dishes. As used in this description, the term "dish(es)" is intended to be generic to any item, single or plural, that can be treated in the dishwasher 10, including, without limitation, dishes, plates, pots, bowls, pans, glassware, and silverware. As illustrated, the dishwasher 10 is a built-in dishwasher implementation, which is designed for mounting under a countertop. However, this description is applicable to other dishwasher implementations such as a stand-alone, drawer-type or a sink-type, for example.

The dishwasher 10 has a variety of systems, some of which are controllable, to implement the automatic cycle of operation. A chassis is provided to support the variety of systems needed to implement the automatic cycle of operation. As illustrated, for a built-in implementation, the chassis includes a frame in the form of a base 12 on which is supported an open-faced tub 14, which at least partially defines a treating chamber 16, having an open face 18, for receiving the dishes. A closure in the form of a door assembly 20 is pivotally mounted to the base 12 for movement between opened and closed positions to selectively open and close the open face 18 of the tub 14. Thus, the door assembly 20 provides selective accessibility to the treating chamber 16 for the loading and unloading of dishes or other items. While illustrated as a single panel, multiple parts can together define the door assembly 20.

The chassis, as in the case of the built-in dishwasher implementation, can be formed by other parts of the dishwasher 10, like the tub 14 and the door assembly 20, in addition to a dedicated frame structure, like the base 12, with them all collectively forming a uni-body frame to which the variety of systems are supported. In other implementations, like the drawer-type dishwasher, the chassis can be a tub that is slidable relative to a frame, with the closure being a part of the chassis or the countertop of the surrounding cabinetry. In a sink-type implementation, the sink forms the tub and the cover closing the open top of the sink forms the closure. Sink-type implementations are more commonly found in recreational vehicles.

The systems supported by the chassis, while essentially limitless, can include dish holding system 30, spray system 40, recirculation system 50, drain system 60, water supply system 70, drying system 80, heating system 90, and filter system 100. These systems are used to implement one or more treating cycles of operation for the dishes, for which there are many, and one of which includes a traditional automatic wash cycle.

A basic traditional automatic wash cycle of operation has a wash phase, where a detergent/water mixture is recirculated and then drained, which is then followed by a rinse phase where water alone or with a rinse agent is recirculated and then drained. An optional drying phase can follow the rinse phase. More commonly, the automatic wash cycle has multiple wash phases and multiple rinse phases. The multiple wash phases can include a pre-wash phase where water, with or without detergent, is sprayed or recirculated on the dishes, and can include a dwell or soaking phase. There can be more than one pre-wash phases. A wash phase, where water with detergent is recirculated on the dishes, follows the pre-wash phases. There can be more than one wash phase; the number of which can be sensor controlled based on the amount of sensed soils in the wash liquid. One or more rinse phases will follow the wash phase(s), and, in some cases, come between wash phases. The number of wash phases can also be sensor controlled based on the amount of sensed soils in the rinse liquid. The wash phases and rinse phases can include the heating of the water, even to the point of one or more of the phases being hot enough for long enough to sanitize the dishes. A drying phase can follow the rinse phase(s). The drying phase can include a drip dry, heated dry, condensing dry, air dry or any combination.

A controller 22 can also be included in the dishwasher 10 and operably couples with and controls the various components of the dishwasher 10 to implement the cycle of operation. The controller 22 can be located within the door assembly 20 as illustrated, or it can alternatively be located somewhere within the chassis. The controller 22 can also be operably coupled with a control panel or user interface 24 for receiving user-selected inputs and communicating information to the user. The user interface 24 can include operational controls such as dials, lights, switches, and displays enabling a user to input commands, such as a cycle of operation, to the controller 22 and receive information.

The dish holding system 30 can include any suitable structure for holding dishes within the treating chamber 16. Exemplary dish holders are illustrated in the form of upper dish racks 32 and lower dish rack 34, commonly referred to as "racks", which are located within or moveably received by the treating chamber 16. The upper dish racks 32 and the lower dish rack 34 are typically mounted for slidable movement in and out of the treating chamber 16 through the open face 18 for ease of loading and unloading. Drawer guides/slides/rails 36 are typically used to slidably mount the upper dish rack 32 to the tub 14. The lower dish rack 34 typically has wheels or rollers 38 that roll along rails 39 formed in sidewalls of the tub 14 and onto the door assembly 20, when the door assembly 20 is in the opened position.

Dedicated dish holders can also be provided. One such dedicated dish holder is a third level rack 28 located above the upper dish rack 32. Like the upper dish rack 32, the third level rack 28 is slidably mounted to the tub 14 with drawer guides/slides/rails 36 and movably received within the treating chamber 16. The third level rack 28 is typically used to hold utensils, such as tableware, spoons, knives, spatulas, etc., in an on-the-side or flat orientation. However, the third level rack 28 is not limited to holding utensils. If an item can fit in the third level rack, it can be washed in the third level rack 28. The third level rack 28 generally has a much shorter height or lower profile than the upper and lower dish racks 32, 34. Typically, the height of the third level rack is short enough that a typical glass cannot be stood vertically in the third level rack 28 and the third level rack 28 still slide into the treating chamber 16.

Another dedicated dish holder can be a silverware basket (not shown), which is typically carried by one of the upper or lower dish racks 32, 34 or mounted to the door assembly 20. The silverware basket typically holds utensils and the like in an upright orientation as compared to the on-the-side or flat orientation of the third level rack 28.

A dispenser assembly 48 is provided to dispense treating chemistry, e.g. detergent, anti-spotting agent, etc., into the treating chamber 16. The dispenser assembly 48 can be mounted on an inner surface of the door assembly 20, as shown, or can be located at other positions within the chassis. The dispenser assembly 48 can dispense one or more types of treating chemistries. The dispenser assembly 48 can be a single-use dispenser or a bulk dispenser, or a combination of both.

Figure 2:
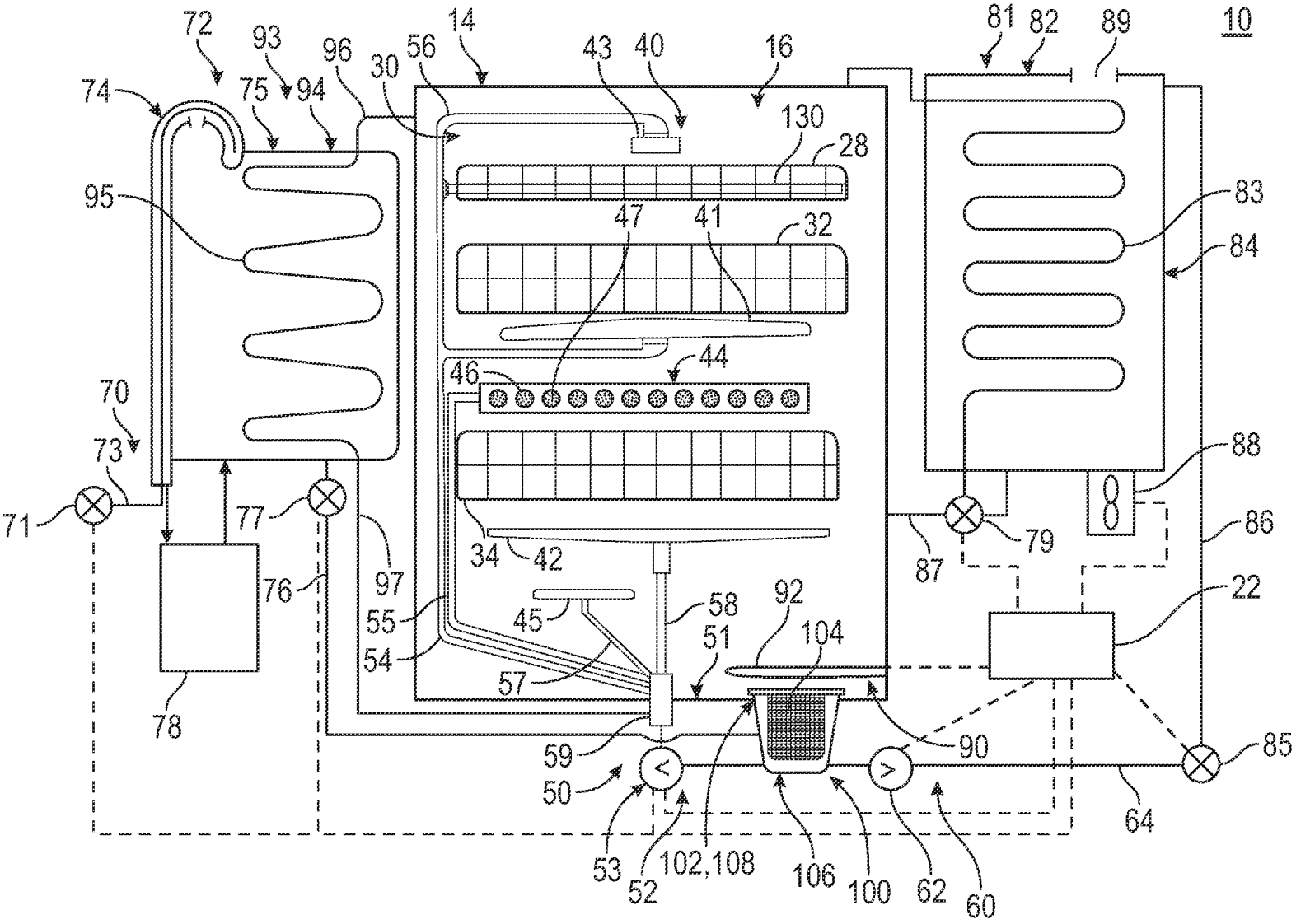
FIG. 2 is a schematic view of the dishwasher of FIG. 1 and illustrating at least some of the plumbing and electrical connections between at least some of systems.

Turning to FIG. 2, the spray system 40 is provided for spraying liquid in the treating chamber 16 and can have multiple spray assemblies or sprayers, some of which can be dedicated to a particular one of the dish holders, to particular area of a dish holder, to a particular type of cleaning, or to a particular level of cleaning, etc. The sprayers can be fixed or movable, such as rotating, relative to the treating chamber 16 or dish holder. Six exemplary sprayers are illustrated and include, an upper spray arm 41, a lower spray arm 42, a third level sprayer 43, a deep-clean sprayer 44, and a spot sprayer 45. The upper spray arm 41 and lower spray arm 42 are illustrated as rotating spray arms, located below the upper dish rack 32 and the lower dish rack 34, respectively, and rotate about a generally centrally located and vertical axis. However, it is contemplated that the upper spray arm 41 or the lower spray arm 42 can be fixed. The third level sprayer 43 is located above the third level rack 28. The third level sprayer 43 is illustrated as being fixed, but could move, such as in rotating. In addition to the third level sprayer 43 or in place of the third level sprayer 43, a sprayer 49, illustrated as a stationary sprayer, can be located at least in part below a portion of the third level rack 28. The sprayer 49 is illustrated as a having a fixed or stationary sprayer housing or tube, carried by the third level rack 28, but the sprayer housing or tube could move, such as, but not limited to, rotating about a longitudinal axis.

The deep-clean sprayer 44 is a manifold extending along a rear wall of the tub 14 and has multiple nozzles 46, with multiple apertures 47, generating an intensified and/or higher pressure spray than the upper spray arm 41, the lower spray arm 42, or the third level sprayer 43. The nozzles 46 can be fixed or move, such as in rotating. The spray emitted by the deep-clean sprayer 44 defines a deep clean zone, which, as illustrated, would like along a rear side of the lower dish rack 34. Thus, dishes needing deep cleaning, such as dishes with baked-on food, can be located in the lower dish rack 34 to face the deep-clean sprayer 44. The deep-clean sprayer 44, while illustrated as only one unit on a rear wall of the tub 14 could comprises multiple units and/or extend along multiple portions, including different walls, of the tub 14, and can be provide above, below or beside any of the dish holders with deep-cleaning is desired.

The spot sprayer 45, like the deep-clean sprayer, can emit an intensified and/or higher pressure spray, especially to a discrete location within one of the dish holders. While the spot sprayer 45 is shown below the lower dish rack 34, it could be adjacent any part of any dish holder or along any wall of the tub where special cleaning is desired. In the illustrated location below the lower dish rack 34, the spot sprayer can be used independently of or in combination with the lower spray arm 42. The spot sprayer 45 can be fixed or can move, such as in rotating.

These six sprayers are illustrative examples of suitable sprayers and are not meant to be limiting as to the type of suitable sprayers.

The recirculation system 50 recirculates the liquid sprayed into the treating chamber 16 by the sprayers of the spray system 40 back to the sprayers to form a recirculation loop or circuit by which liquid can be repeatedly and/or continuously sprayed onto dishes in the dish holders. The recirculation system 50 can include a sump 51 and a pump assembly 52. The sump 51 collects the liquid sprayed in the treating chamber 16 and can be formed by a sloped or recess portion of a bottom wall of the tub 14. The pump assembly 52 can include one or more pumps such as recirculation pump 53. The sump 51 can also be a separate module that is affixed to the bottom wall and include the pump assembly 52.

Multiple supply conduits 54, 55, 56, 57, 58 fluidly couple the sprayers 43, 44, 45, 49 to the recirculation pump 53. A recirculation valve 59 can selectively fluidly couple each of the conduits 54-58 to the recirculation pump 53. While each sprayer 43, 44, 45, 49 is illustrated as having a corresponding dedicated supply conduit 54-58 one or more subsets, comprising multiple sprayers from the total group of sprayers 43, 44, 45, 49, can be supplied by the same conduit, negating the need for a dedicated conduit for each sprayer. For example, a single conduit can supply the upper spray arm 41 and the third level sprayer 43. Another example is that the sprayer 49 is supplied liquid by the conduit 56, which also supplies the third level sprayer 43.

The recirculation valve 59, while illustrated as a single valve, can be implemented with multiple valves. Additionally, one or more of the conduits can be directly coupled to the recirculation pump 53, while one or more of the other conduits can be selectively coupled to the recirculation pump with one or more valves. There are essentially an unlimited number of plumbing schemes to connect the recirculation system 50 to the spray system 40. The illustrated plumbing is not limiting.

A drain system 60 drains liquid from the treating chamber 16. The drain system 60 includes a drain pump 62 fluidly coupled the treating chamber 16 to a drain line 64. As illustrated the drain pump 62 fluidly couples the sump 51 to the drain line 64.

While separate recirculation and drain pumps 53 and 62 are illustrated, a single pump can be used to perform both the recirculating and the draining functions. Alternatively, the drain pump 62 can be used to recirculate liquid in combination with the recirculation pump 53. When both a recirculation pump 53 and drain pump 62 are used, the drain pump 62 is typically more robust than the recirculation pump 53 as the drain pump 62 tends to have to remove solids and soils from the sump 51, unlike the recirculation pump 53, which tends to recirculate liquid which has solids and soils filtered away to some extent.

A water supply system 70 is provided for supplying fresh water to the dishwasher 10 from a household water supply via a household water valve 71. The water supply system 70 includes a water supply unit 72 having a water supply conduit 73 with a siphon break 74. While the water supply conduit 73 can be directly fluidly coupled to the tub 14 or any other portion of the dishwasher 10, the water supply conduit is shown fluidly coupled to a supply tank 75, which can store the supplied water prior to use. The supply tank 75 is fluidly coupled to the sump 51 by a supply line 76, which can include a controllable valve 77 to control when water is released from the supply tank 75 to the sump 51.

The supply tank 75 can be conveniently sized to store a predetermined volume of water, such as a volume required for a phase of the cycle of operation, which is commonly referred to as a "charge" of water. The storing of the water in the supply tank 75 prior to use is beneficial in that the water in the supply tank 75 can be "treated" in some manner, such as softening or heating prior to use.

A water softener 78 is provided with the water supply system 70 to soften the fresh water. The water softener 78 is shown fluidly coupling the water supply conduit 73 to the supply tank 75 so that the supplied water automatically passes through the water softener 78 on the way to the supply tank 75. However, the water softener 78 could directly supply the water to any other part of the dishwasher 10 than the supply tank 75, including directly supplying the tub 14. Alternatively, the water softener 78 can be fluidly coupled downstream of the supply tank 75, such as in-line with the supply line 76. Wherever the water softener 78 is fluidly coupled, it can be done so with controllable valves, such that the use of the water softener 78 is controllable and not mandatory.

A drying system 80 is provided to aid in the drying of the dishes during the drying phase. The drying system as illustrated includes a condensing assembly 81 having a condenser 82 formed of a serpentine conduit 83 with an inlet fluidly coupled to an upper portion of the tub 14 and an outlet fluidly coupled to a lower portion of the tub 14, whereby moisture laden air within the tub 14 is drawn from the upper portion of the tub 14, passed through the serpentine conduit 83, where liquid condenses out of the moisture laden air and is returned to the treating chamber 16 where it ultimately evaporates or is drained via the drain pump 62. The serpentine conduit 83 can be operated in an open loop configuration, where the air is exhausted to atmosphere, a closed loop configuration, where the air is returned to the treating chamber, or a combination of both by operating in one configuration and then the other configuration.

To enhance the rate of condensation, the temperature difference between the exterior of the serpentine conduit 83 and the moisture laden air can be increased by cooling the exterior of the serpentine conduit 83 or the surrounding air. To accomplish this, an optional cooling tank 84 is added to the condensing assembly 81, with the serpentine conduit 83 being located within the cooling tank 84. The cooling tank 84 is fluidly coupled to at least one of the spray system 40, recirculation system 50, drain system 60 or water supply system 70 such that liquid can be supplied to the cooling tank 84. The liquid provided to the cooling tank 84 from any of the systems 40-70 can be selected by source and/or by phase of cycle of operation such that the liquid is at a lower temperature than the moisture laden air or even lower than the ambient air.

As illustrated, the liquid is supplied to the cooling tank 84 by the drain system 60. A valve 85 fluidly connects the drain line 64 to a supply conduit 86 fluidly coupled to the cooling tank 84. A return conduit 87 fluidly connects the cooling tank 84 back to the treating chamber 16 via a return valve 79. In this way a fluid circuit is formed by the drain pump 62, drain line 64, valve 85, supply conduit 86, cooling tank 84, return valve 79 and return conduit 87 through which liquid can be supplied from the treating chamber 16, to the cooling tank 84, and back to the treating chamber 16. Alternatively, the supply conduit 86 could fluidly couple to the drain line 64 if re-use of the water is not desired.

To supply cold water from the household water supply via the household water valve 71 to the cooling tank 84, the water supply system 70 would first supply cold water to the treating chamber 16, then the drain system 60 would supply the cold water in the treating chamber 16 to the cooling tank 84. It should be noted that the supply tank 75 and cooling tank 84 could be configured such that one tank performs both functions.

The drying system 80 can use ambient air, instead of cold water, to cool the exterior of the serpentine conduit 83. In such a configuration, a blower 88 is connected to the cooling tank 84 and can supply ambient air to the interior of the cooling tank 84. The cooling tank 84 can have a vented top 89 to permit the passing through of the ambient air to allow for a steady flow of ambient air blowing over the serpentine conduit 83.

The cooling air from the blower 88 can be used in lieu of the cold water or in combination with the cold water. The cooling air will be used when the cooling tank 84 is not filled with liquid. Advantageously, the use of cooling air or cooling water, or combination of both, can be selected on the site-specific environmental conditions. If ambient air is cooler than the cold water temperature, then the ambient air can be used. If the cold water is cooler than the ambient air, then the cold water can be used. Cost-effectiveness can also be considered or accounted for when selecting between cooling air and cooling water. The blower 88 can be used to dry the interior of the cooling tank 84 after the water has been drained. Suitable temperature sensors for the cold water and the ambient air can be provided and send their temperature signals to the controller 22, which can determine which of the two is colder at any time or phase of the cycle of operation.

A heating system 90 is provided for heating water used in the cycle of operation. The heating system 90 includes a heater 92, such as an immersion heater, located in the treating chamber 16 at a location where it will be immersed by the water supplied to the treating chamber 16. The heater 92 need not be an immersion heater, it can also be an in-line heater located in any of the conduits. There can also be more than one heater 92, including both an immersion heater and an in-line heater.

The heating system 90 can also include a heating circuit 93, which includes a heat exchanger 94, illustrated as a serpentine conduit 95, located within the supply tank 75, with a supply conduit 96 supplying liquid from the treating chamber 16 to the serpentine conduit 95, and a return conduit 97 fluidly coupled to the treating chamber 16. The heating circuit 93 is fluidly coupled to the recirculation pump 53 either directly or via the recirculation valve 59 such that liquid that is heated as part of a cycle of operation can be recirculated through the heat exchanger 94 to transfer the heat to the charge of fresh water residing in the supply tank 75. As most wash phases use liquid that is heated by the heater 92, this heated liquid can then be recirculated through the heating circuit 93 to transfer the heat to the charge of water in the supply tank 75, which is typically used in the next phase of the cycle of operation.

A filter system 100 is provided to filter un-dissolved solids from the liquid in the treating chamber 16. The filter system 100 includes a coarse filter 102 and a fine filter 104, which can be a removable basket 106 residing the sump 51, with the coarse filter 102 being a screen 108 circumscribing the removable basket 106. Additionally, the recirculation system 50 can include a rotating filter in addition to or in place of the either or both of the coarse filter 102 and fine filter 104. Other filter arrangements are contemplated such as an ultra-filtration system.

Figure 3:
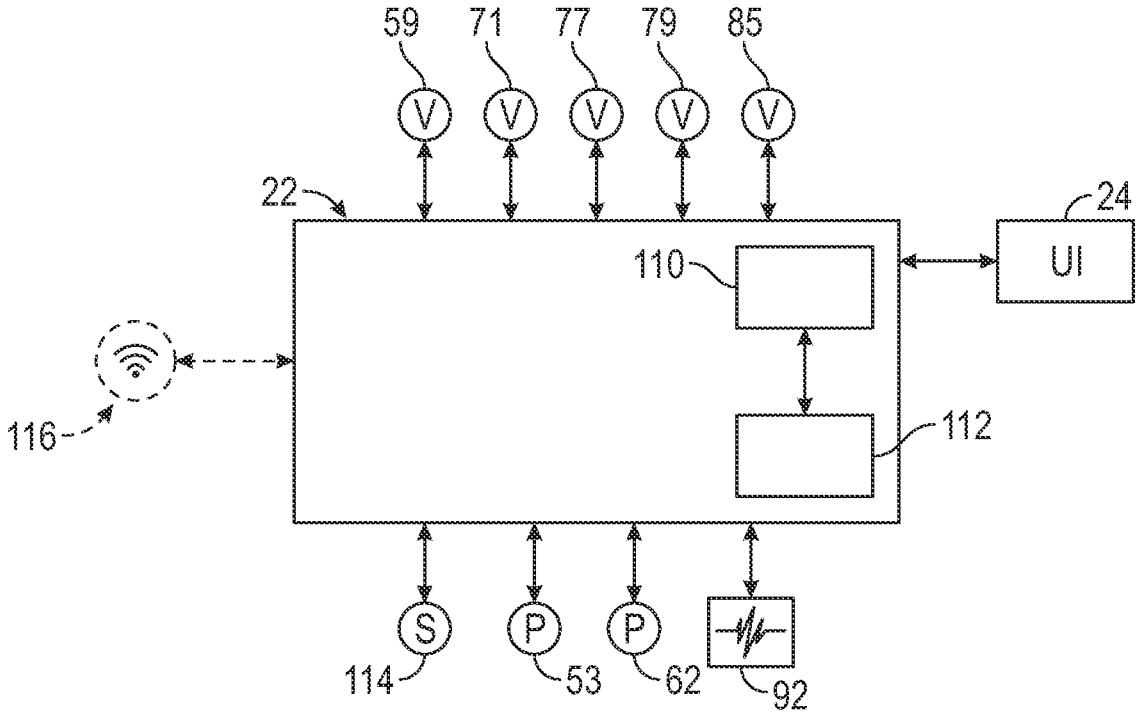
FIG. 3 is a schematic view of a controller of the dishwasher of FIGS. 1 and 2.

As illustrated schematically in FIG. 3, the controller 22 can be coupled with the heater 92 for heating the wash liquid during a cycle of operation, the drain pump 62 for draining liquid from the treating chamber 16, and the recirculation pump 53 for recirculating the wash liquid during the cycle of operation. The controller 22 can be provided with a memory 110 and a central processing unit (CPU) 112. The memory 110 can be used for storing control software that can be executed by the CPU 112 in completing a cycle of operation using the dishwasher 10 and any additional software. For example, the memory 110 can store one or more pre-programmed automatic cycles of operation that can be selected by a user and executed by the dishwasher 10. The controller 22 can also receive input from one or more sensors 114. Non-limiting examples of sensors that can be communicably coupled with the controller 22 include, to name a few, ambient air temperature sensor, treating chamber temperature sensor, water supply temperature sensor, door open/close sensor, and turbidity sensor to determine the soil load associated with a selected grouping of dishes, such as the dishes associated with a particular area of the treating chamber. The controller 22 can also communicate with the recirculation valve 59, the household water valve 71, the controllable valve 77, the return valve 79, and the valve 85. Optionally, the controller 22 can include or communicate with a wireless communication device 116.

Figure 4:
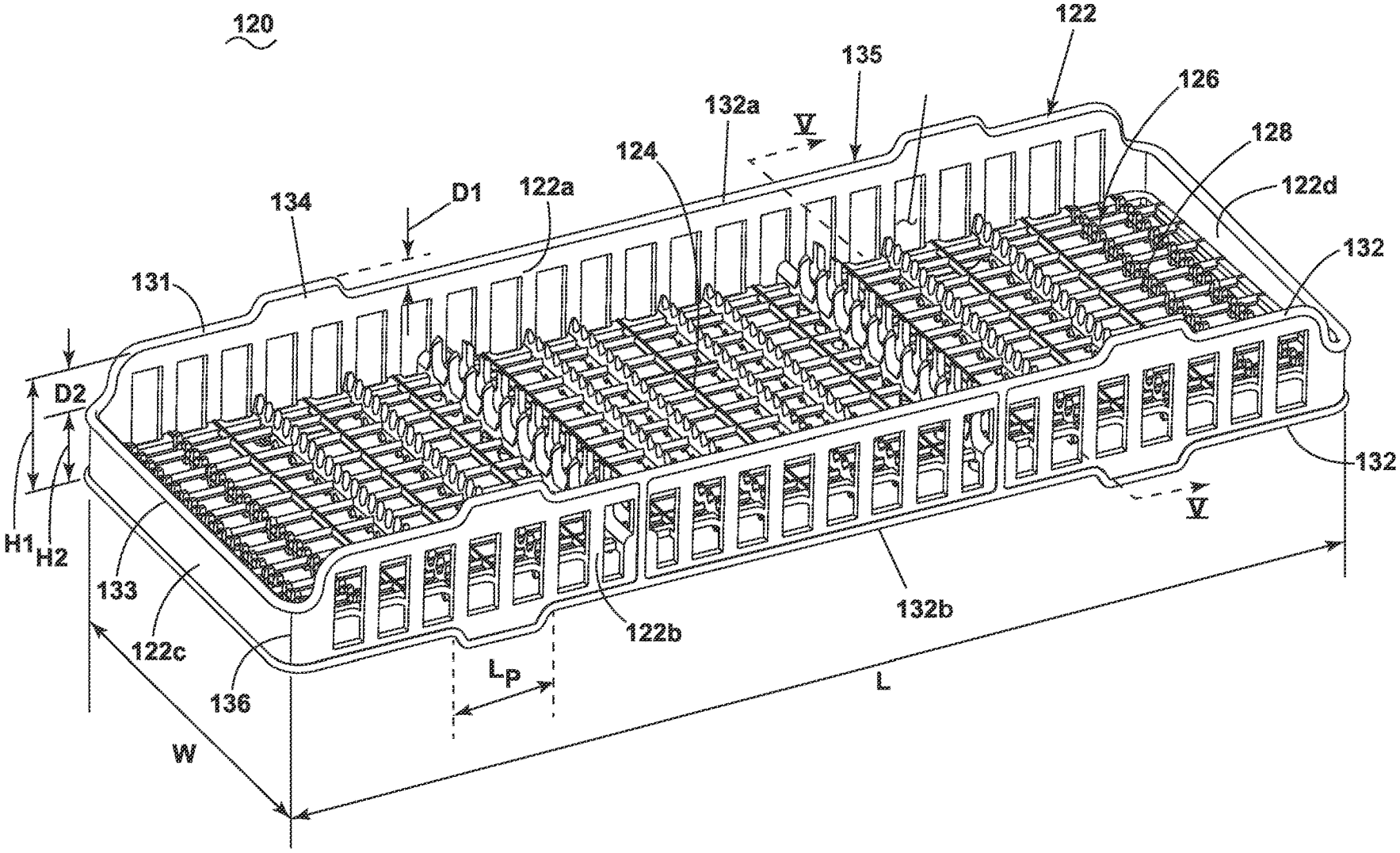
FIG. 4 is a perspective view of a repositionable tray receivable in the dish rack of FIG. 1 according to an aspect of the disclosure herein.

FIG. 4 is a perspective view of a repositionable tray 120, which is described as being received in the third level rack 28. It is further contemplated that the repositionable tray 120 can also be receivable in the upper dish rack 32 or both the upper dish rack 32 and the third level rack 28. The repositionable tray 120 and corresponding rack are configured such that the tray 120 can be placed in two alternative orientations relative to the rack, which result in the tray 120 being spaced at two different heights, respectively, relative to a rack located beneath the tray 120.

The repositionable tray 120 can be substantially rectangular in shape and have at least one sidewall 122, illustrated as four sidewalls, and a base wall 124 defining at least one container, by way of non-limiting example a primary container 126 for receiving dishes. In one non-limiting example the base wall 124 is a cutlery tray 128. It should be understood that while illustrated as rectangular, the repositionable tray 120 can have any desired shape.

The at least one sidewall 122 can include a first sidewall 122*a* and a second sidewall 122*b* opposite the first sidewall, both defining a length (L) of the repositionable tray 120. Each of the first and second sidewalls 122*a*, 122*b* can include a set of openings 130 for draining water during operation. The first and second sidewalls can define opposing peripheral edges 132 of the repositionable tray 120, a primary edge 132*a* and a secondary edge 132*b*. The opposing peripheral edges 132 can define a perimeter 135 of the repositionable tray 120. The opposing peripheral edges 132 can include at least one protrusion 134 extending laterally from the opposing peripheral edges 132 a first dimension (D1). The at least one protrusion can have a length (Lp) measured along the opposing peripheral edges 132. By way of non-limiting example each of the first and second sidewalls 122*a*, 122*b* include four protrusions 134.

The at least one sidewall 122 can include a third sidewall 122*c* and a fourth sidewall 122*d* opposite the third sidewall 122*c*, defining a width (W) of the repositionable tray 120. The third and fourth sidewalls 122*c*, 122*d* can further define the opposing peripheral edges 132 of the holder. In one aspect of the disclosure herein, the first and second sidewalls 122*a*, 122*b* define a first height (H1) and the second and third sidewalls 122*c*, 122*d* define a second height (H2) smaller than the first height (H1). A first primary edge 131 can define the primary edge 132*a* of the first and second sidewalls 122*a*, 122*b* while a second primary edge 133 can define the primary edge 132*a* of the third and fourth sidewalls 122*c*, 122*d*. The second primary edge 133 can be located closer to the base wall 124 than the first primary edge 131. The four sidewalls 122*a*, 122*b*, 122*c*, 122*d* can connect to each other to define four corners 136 of the primary container 126. The primary edge 132*a* can transition by a second dimension (D2) between the first primary edge 131 and the second primary edge 133 at each of the four corners 136. The second dimension (D2) can be defined as the difference between the first and second heights (H1), (H2).

In one aspect, the secondary edge 132*b* defines a constant peripheral edge. In other words besides the at least one protrusion 134, the secondary edge 132*b* does not include any transitional dimensions like the primary edge 132*a*.

Figure 5:
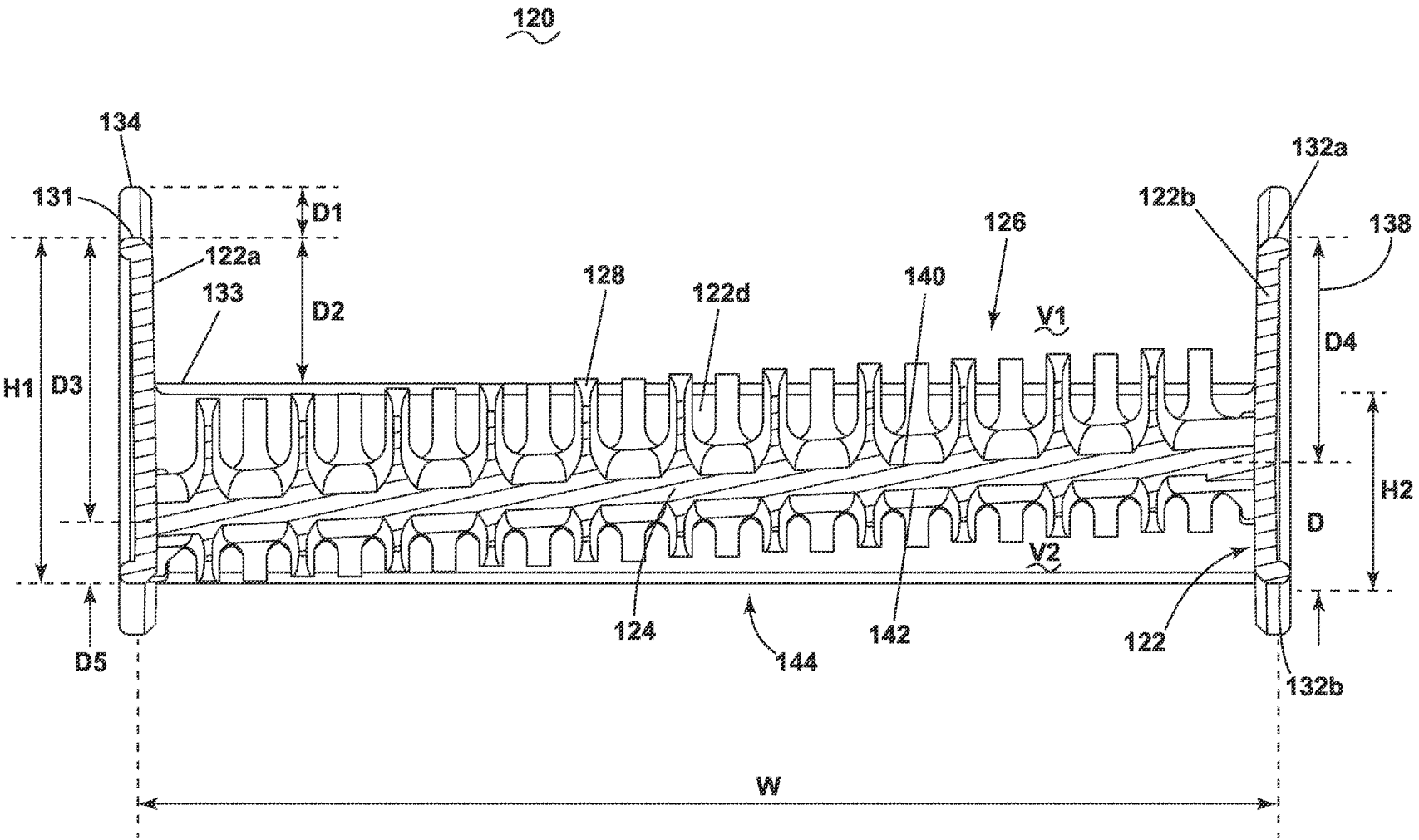
FIG. 5 is a cross-sectional view taken along line V-V of FIG. 4 of the repositionable tray.

Turning to FIG. 5, a cross-sectional view of the repositionable tray 120 along line V-V is illustrated. It can more clearly be seen that the base wall 124 can be angled with respect to the first and second sidewalls 122*a*, 122*b*. In other words, the primary container 126 can have a transitional depth 138. A third dimension (D3) can define a depth of the primary container 126 proximate the first sidewall 122*a* measured from the first primary edge 131 to the base wall 124. A fourth dimension (D4) different than the third dimension (D3) can define a depth of the primary container 126 proximate the second sidewall 122*b* measured from the first primary edge 131 to the base wall 124. In one aspect the fourth dimension (D3) is less than the third dimension (D3). It is further contemplated that the base wall 124 is angled along a continuous slope as illustrated or a discontinuous slope. While illustrated as angled, it should be understood that the base wall 124 can be horizontal or non-sloped. The primary container 126 has a first volume (V1) defined by the length (L), width (W), third dimension (D3) and fourth dimension (D4) described herein.

The base wall 124 can define a first side 140 and a second side 142 opposite the first side. The first side 140 can define at least a portion of the primary container 126. The second side 142, along with the sidewalls 122 can define a secondary container 144. A fifth dimension (D5) can define a depth of the secondary container 144 proximate the first sidewall 122*a* measured from the secondary edge 132*b* to the base wall 124. A sixth dimension (D6) different than the fifth dimension (D5) can define a depth of the secondary container 144 proximate the second sidewall 122*b* measured from the secondary edge 132*b* to the base wall 124. The secondary container 144 has a second volume (V2) defined by the length (L), width (W), fifth dimension (D5) and sixth dimension (D6) described herein. In one aspect of the disclosure herein, the second volume (V2) is less than the first volume (V1).

Figure 6:
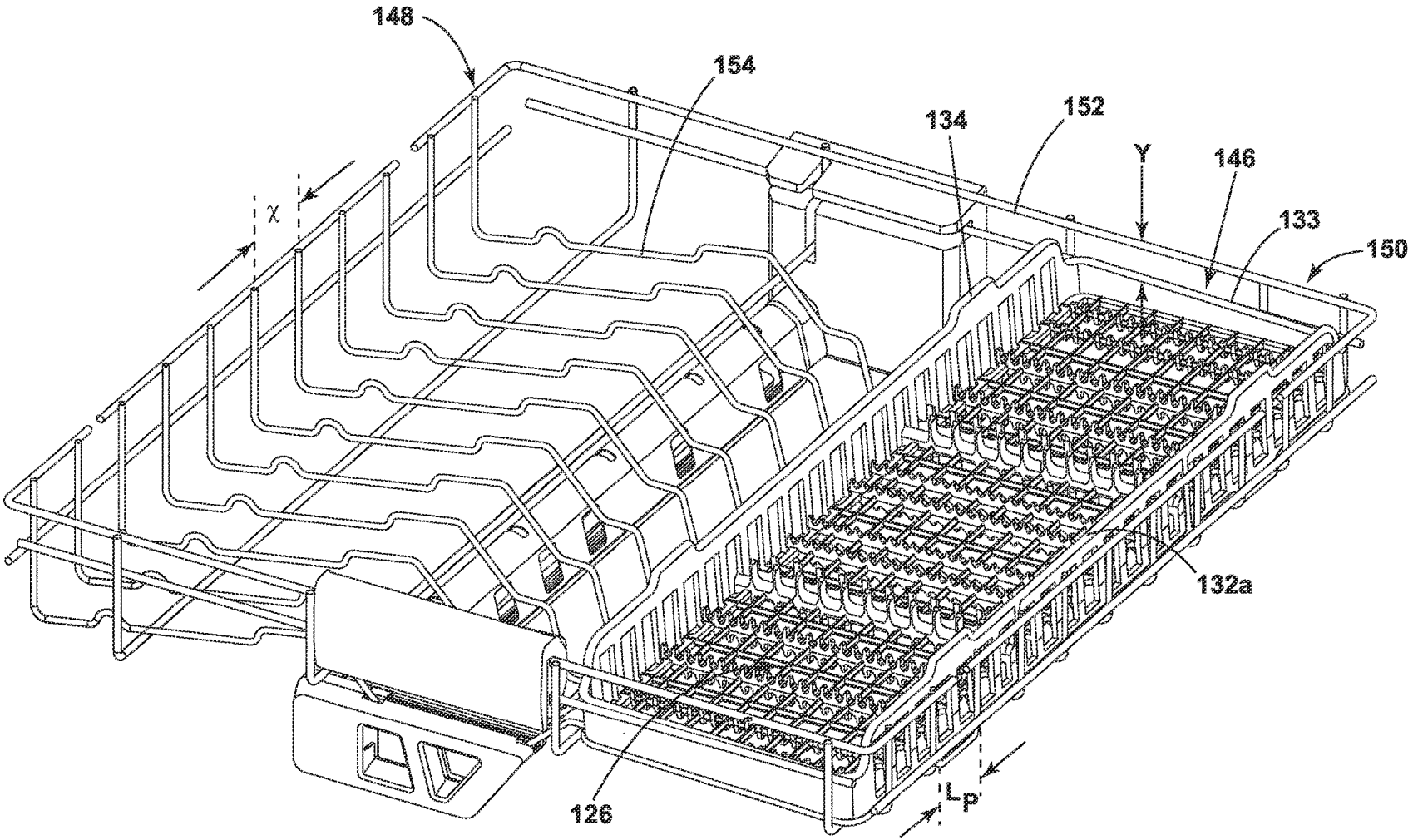
FIG. 6 is a perspective view of the repositionable tray in a dish rack illustrating a first position according to an aspect of the disclosure herein.

FIG. 6 is a perspective view illustrating the repositionable tray 120 in a first position 146 located in an upper dish rack 148, by way of non-limiting example the third level rack 28 or the upper dish rack 32. Some numerical descriptors already described herein have been removed for clarity. The dish rack 148 can be defined by a frame 150 including an upper rim 152. The frame 150 can be defined by tines 154 spaced apart a distance (X). The length (Lp) of the at least one protrusion 134 described herein can be less than the distance (X).

The at least one protrusion 134 can fit between the tines 154 when received in the dish rack 148. In the first position 146, the second primary edge 133 can be spaced a distance (Y) from the upper rim 152 and the primary container 126 is oriented to receive dishes.

Figure 7:
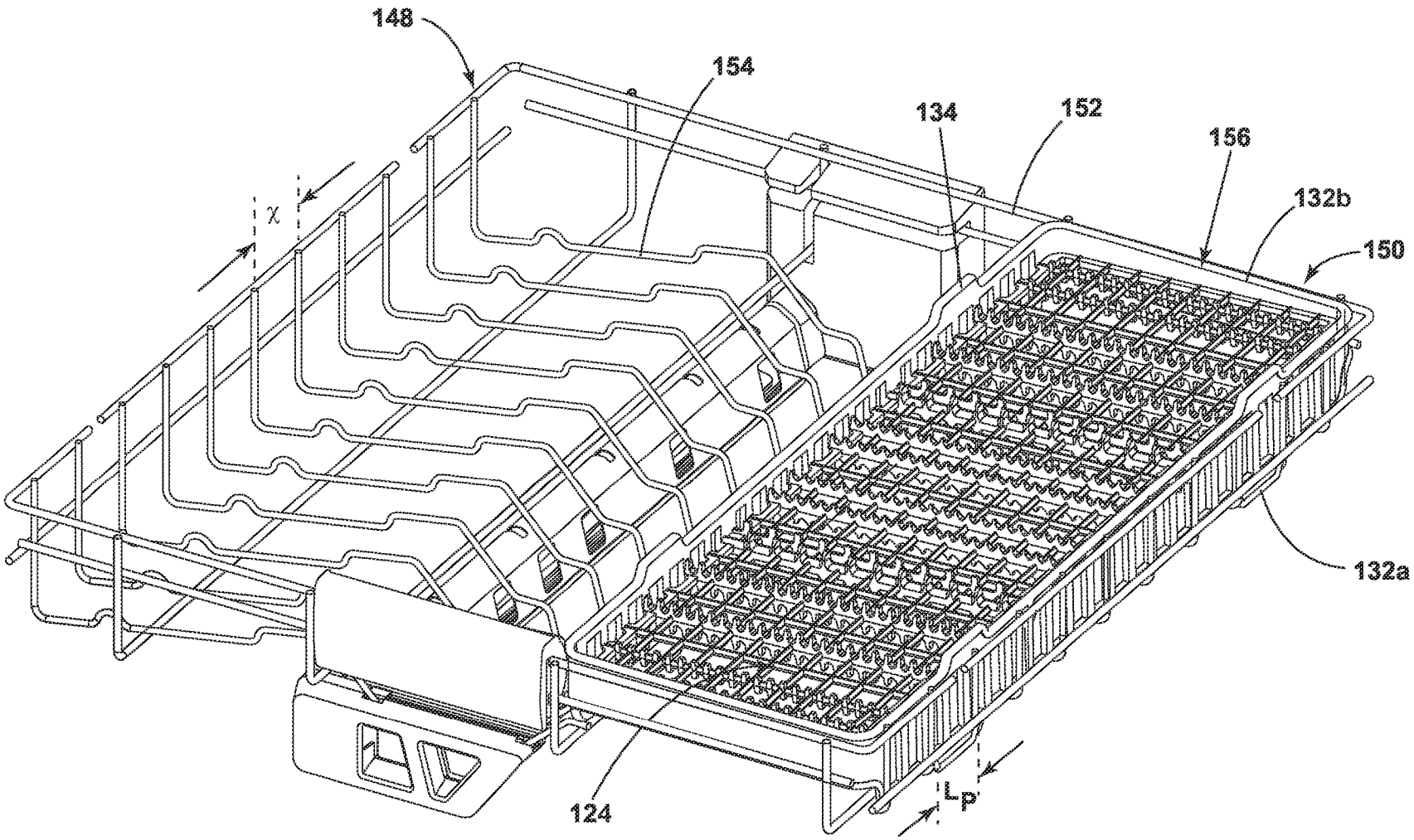
FIG. 7 is a perspective view of the repositionable tray in the dish rack of FIG. 6 illustrating a second position.

FIG. 7 illustrates the repositionable tray 120 in a second position 156 in the dish rack 148. Again, some numerical descriptors already described herein have been removed for clarity. In the second position 156, the secondary edge 132*b* can be level with the upper rim 152 and the secondary container 144 is oriented to receive dishes.

Figure 8:
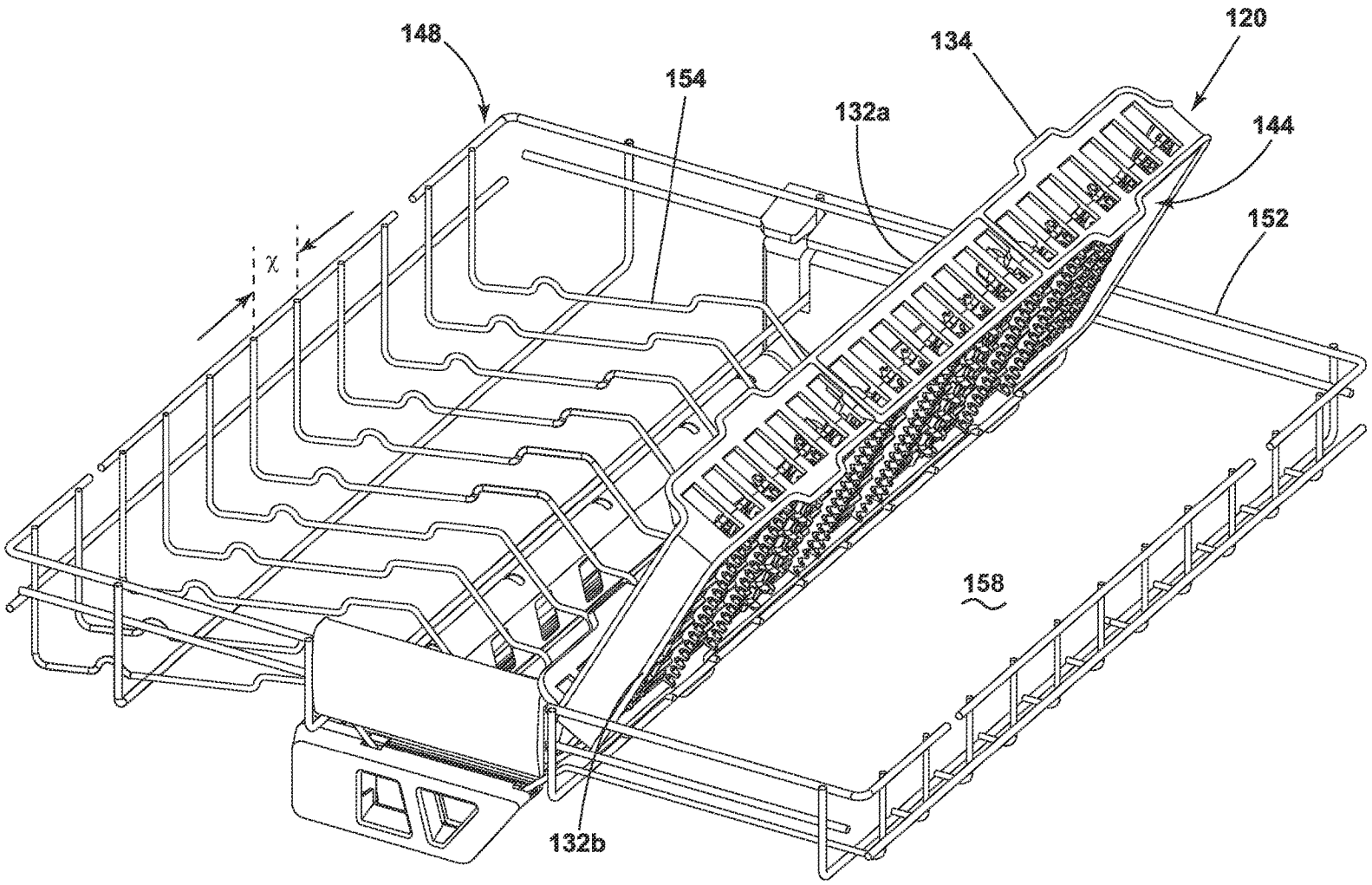
FIG. 8 is a perspective view of the repositionable tray illustrating movement between the first position and the second position according to an aspect of the disclosure herein.

Turning to FIG. 8, the repositionable tray 120 is shown in transition between the first position 146 (FIG. 6) and the second position 156 (FIG. 7). The dish rack 148 can include an opening 158. When in the first position 146 or the second position 156, the repositionable tray 120 can close the opening 158. It should be understood that the repositionable tray 120 is a repositionable tray that is removable and can be flipped, or turned 180 degrees, to provide more space below the upper dish rack 148 in the dishwasher 10.

Figure 9:
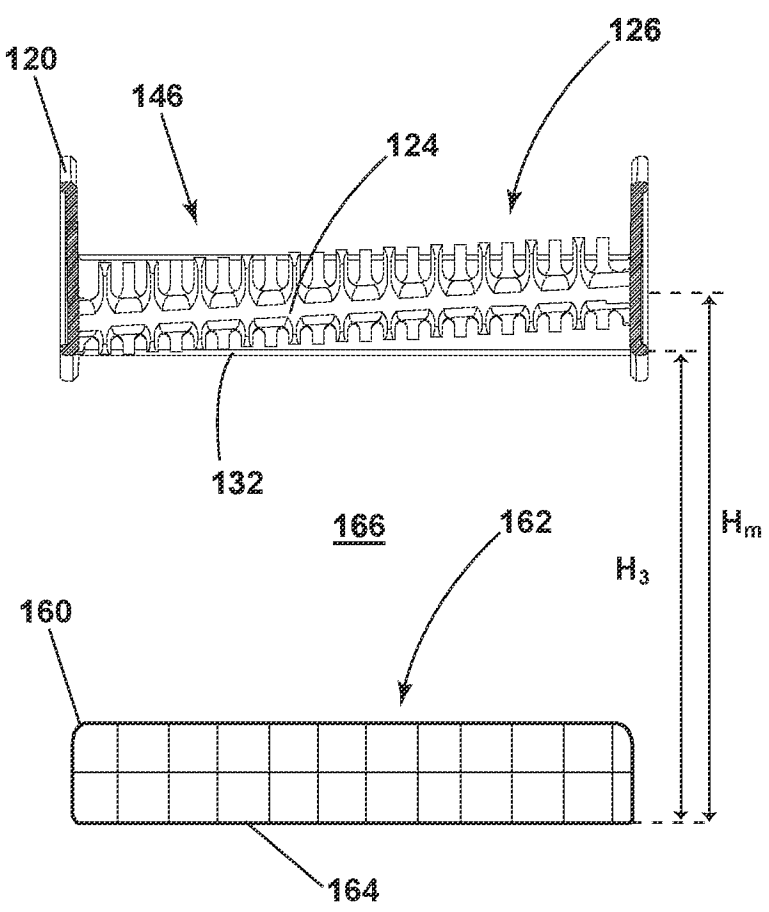
FIG. 9 is a schematic of the repositionable tray in the first position situated above a lower dish rack according to an aspect of the disclosure herein.

Turning to FIG. 9, the repositionable tray 120 is schematically illustrated in the first position 146. The first position 146 creates a third height ($H_3$) between a lower dish rack 160 and the repositionable tray 120 when placed in the dish rack the 148 (FIG. 9). The lower dish rack 160 can be the upper or lower dish racks 32, 34 described herein. The lower dish rack 160 can define a dish container 162 having a seat 164 for supporting dishes during a wash cycle. This third height ($H_3$) provides a first given amount of space 166 for loading standard dishes into the lower dish rack 160. The standard dishes can include, but are not limited to mugs.

Figure 10:
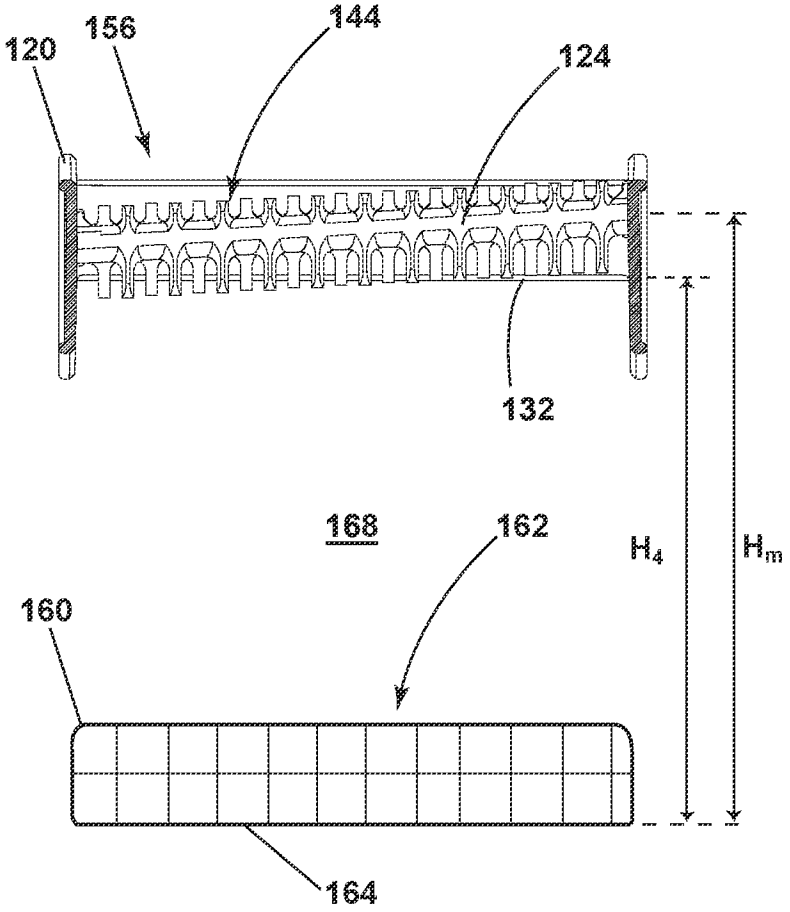
FIG. 10 is a schematic of the repositionable tray in the second position situated above the lower dish rack of FIG. 9.

FIG. 10, schematically illustrates the repositionable tray 120 in the second position 156. The second position 156 creates a fourth height ($H_4$) between the lower dish rack 160 and the repositionable tray 120 when placed in the dish rack the 148 (FIG. 9). The fourth height (H4) is greater than the third height ($H_3$). This fourth height ($H_4$) provides a second given amount of space 168 greater than the first given amount of space 166 for loading tall dishes in the lower dish rack 160. Tall dishes can include, but are not limited to glasses that are taller than the standard dishes described herein.

While the heights illustrated in FIGS. 9 and 10 are measured between the seat 164 of the lower dish rack 160 and the opposing peripheral edges 132 of the of the repositionable tray 120, it should be understood that the height can be measured between any two points of the lower dish rack 160 and the repositionable tray 120. Further, an angled base wall 124 can define a varying height along the width (W) where a maximum height ($H_m$) is present along the outside of the lower dish rack 160 where dishes such glasses are normally placed in a dishwasher.

Figure 11:
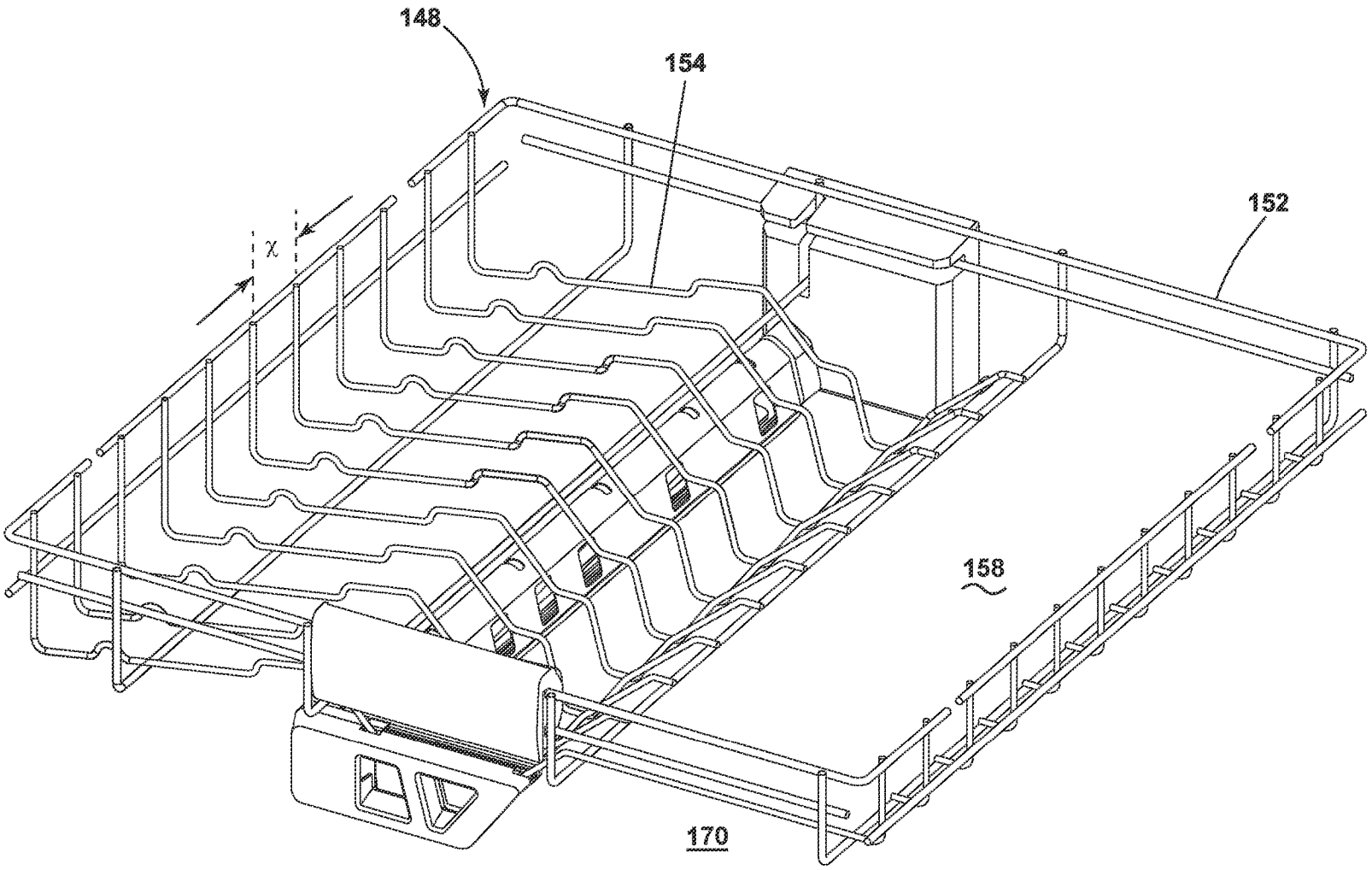
FIG. 11 is a perspective view of the dish rack of FIG. 6 with the repositionable tray removed according to an aspect of the disclosure herein.

FIG. 11 is a perspective view of the dish rack 148 with the repositionable tray 120 completely removed leaving the opening 158. When in the first position 146 or the second position 156, the repositionable tray 120 can close the opening 158. It should be understood that the complete removal of the repositionable tray 120 provides a third given amount of space 170 greater than the second given amount of space 168 for loading even taller dishes than the aforementioned dishes into the lower dish rack 160 (FIG. 10).

While "a set of" or "a plurality of" various elements will be described, it will be understood that "a set" or "a plurality" can include any number of the respective elements, including only one element. It should be understood that the term dishes herein can be cutlery, glasses, bowls, plates, appliance parts, cooking utensils, or the like.

To the extent not already described, the different features and structures of the various aspects can be used in combination with each other as desired. That one feature cannot be illustrated in all of the aspects is not meant to be construed that it cannot be, but is done for brevity of description. Thus, the various features of the different aspects can be mixed and matched as desired to form new aspects, whether or not the new aspects are expressly described. Combinations or permutations of features described herein are covered by this disclosure.

This written description uses examples to disclose aspects of the disclosure, including the best mode, and also to enable any person skilled in the art to practice aspects of the disclosure, including making and using any devices or systems and performing any incorporated methods. While aspects of the disclosure have been specifically described in connection with certain specific details thereof, it is to be understood that this is by way of illustration and not of limitation. Reasonable variation and modification are possible within the scope of the forgoing disclosure and drawings without departing from the spirit of the disclosure, which is defined in the appended claims.

What is claimed is:

1. A dishwasher for treating dishes according to a cycle of operation, the dishwasher comprising:

a tub at least partially defining a treating chamber;

at least an upper dish rack and a lower dish rack received within the treating chamber for supporting dishes; and a reversible tray carried by one of the upper or lower dish rack and removably disposed within the upper or lower dish rack to flip between a first position and a second position, the reversible tray having a first sidewall and a second sidewall and a base wall angled with respect to the first and second sidewalls, wherein the base wall divides the reversible tray into a primary container and a secondary container, the primary container configured to receive dishes when in the first position and the secondary container configured to receive dishes when in the second position.

2. The dishwasher of claim 1 further comprising a lower dish rack received within the treating chamber, and having a least a portion with a seat for supporting dishes.

3. The dishwasher of claim 2 wherein the dish rack is an upper dish rack located above the lower dish rack and has an opening overlying the seat of the lower dish rack.

4. The dishwasher of claim 3 wherein in the first position, the reversible tray defines a first height with the seat, and in the second position, the reversible tray defines a second height with the seat, the second height being greater than the first height.

5. The dishwasher of claim 1 wherein the first sidewall, second sidewall, and base wall together define at least one container.

6. The dishwasher of claim 5 wherein the first and second sidewalls define opposing peripheral edges of the at least one container.

7. The dishwasher of claim 6 wherein the opposing peripheral edges include a primary edge defining a perimeter of the primary container and a secondary edge defining a perimeter of the secondary container.

8. The dishwasher of claim 7 wherein the primary edge is vertically spaced from an upper rim of the dish rack to define the first position.

9. The dishwasher of claim 8 wherein the secondary edge is level with the upper rim of the dish rack to define the second position.

10. The dishwasher of claim 6 wherein the opposing peripheral edges include at least one protrusion.

11. The dishwasher of claim 10 wherein the upper dish rack includes tines spaced apart to receive the at least one protrusion.

12. The dishwasher of claim 1 wherein the first sidewall has a first depth and the second sidewall has a second depth, the first depth being greater than the second depth.

13. The dishwasher of claim 1 wherein the reversible tray is removable during a cycle of operation to define an open space in the upper dish rack.

14. A reversible tray for a dishwasher having an upper dish rack and a lower dish rack, the reversible tray carried by one of the upper or lower dish rack and removably disposed within the upper or lower dish rack to flip between a first position and a second position, the reversible tray having a first sidewall and a second sidewall and a base wall angled with respect to the first and second sidewalls, wherein the base wall divides the reversible tray into a primary container and a secondary container, the primary container configured to receive dishes when in the first position and the secondary container configured to receive dishes when in the second position.

15. The reversible tray of claim 14 wherein in the first position, the reversible tray defines a first height between the upper dish rack and the lower dish rack, and in the second position, the reversible tray defines a second height between the upper dish rack and the lower dish rack, the second height being greater than the first height.

16. The reversible tray of claim 14 wherein the reversible tray is a cutlery tray.

17. The reversible tray of claim 14 wherein the primary container defines a first volume and the secondary container defines a second volume less than the first volume.

18. The reversible tray of claim 14 wherein the reversible tray is removable during a cycle of operation to define an open space in the dish rack.

19. The reversible tray of claim 14 wherein the first sidewall, second sidewall, and base wall together define at least one container and the first and second sidewalls define opposing peripheral edges of the at least one container.

20. The reversible tray of claim 19 wherein the opposing peripheral edges include a primary edge defining a perimeter of the primary container and a secondary edge defining a perimeter of the secondary container.

* * * * *